US006905014B2

(12) United States Patent
Eldin

(10) Patent No.: US 6,905,014 B2
(45) Date of Patent: Jun. 14, 2005

(54) TRANSPARENT SCALED COINS CONTAINER

(76) Inventor: Hatim Gamal Eldin, 4085B S. Four Mile Run Dr., Arlington, VA (US) 22204

( * ) Notice: Subject to any disclaimer, the term of this patent is extended or adjusted under 35 U.S.C. 154(b) by 179 days.

(21) Appl. No.: 10/299,805

(22) Filed: Nov. 20, 2002

(65) Prior Publication Data

US 2004/0094434 A1 May 20, 2004

(51) Int. Cl.[7] ..... B65D 85/00

(52) U.S. Cl. ..... 206/0.84; 206/445; 206/470; 206/471; 220/4.23; 220/4.24

(58) Field of Search ..... 206/0.82–0.84, 206/445, 461, 470–471, 526; 220/4.21–4.25; 232/5; D99/34

(56) References Cited

U.S. PATENT DOCUMENTS

| | | | | | |
|---|---|---|---|---|---|
| 518,948 | A | | 5/1894 | Hayden | |
| 712,087 | A | * | 10/1902 | O'Neil et al. | 206/0.82 |
| 837,685 | A | * | 12/1906 | Kintz | 206/0.82 |
| 2,292,721 | A | * | 8/1942 | Stanton | 206/445 |
| D161,937 | S | * | 2/1951 | Kelly | D99/34 |
| 2,544,118 | A | * | 3/1951 | Went | 206/0.83 |
| 2,563,291 | A | * | 8/1951 | Thompson | 232/5 |
| 3,095,084 | A | * | 6/1963 | White | 206/0.83 |
| 3,122,441 | A | * | 2/1964 | Smith | 426/91 |
| 3,346,109 | A | | 10/1967 | Duran | |
| 3,695,503 | A | * | 10/1972 | Mascetti, Jr. | 229/406 |
| 3,776,375 | A | | 12/1973 | Rohdin | |
| 4,036,358 | A | | 7/1977 | Kelley | |
| 4,183,432 | A | | 1/1980 | Lemaire | |
| 4,240,544 | A | | 12/1980 | Barnhart et al. | |
| 4,290,523 | A | | 9/1981 | Wallace | |
| 4,339,071 | A | | 7/1982 | Hall | |
| 4,545,394 | A | | 10/1985 | Chang | |
| D303,863 | S | | 10/1989 | Purifoy | |
| 5,121,835 | A | * | 6/1992 | Grupe | 206/459.5 |
| 5,957,275 | A | | 9/1999 | Lemaire | |
| 2002/0162756 | A1 | * | 11/2002 | Seligman et al. | 206/0.82 |

FOREIGN PATENT DOCUMENTS

| | | | | |
|---|---|---|---|---|
| GB | 2029360 | A | * 3/1980 | B65D/75/22 |

* cited by examiner

*Primary Examiner*—Byron P. Gehman
(74) *Attorney, Agent, or Firm*—Robert Plett Bell

(57) ABSTRACT

A reusable coin holder, counter and sorter, known as COINSMETER™ utilizes inexpensive semi-disposable packaging technology. In each half of a semi-elastic plastic material, at least one grove is provided in the shape of half cylinder. When the two halves are closed, a cylinder or a number of cylinders are created. Each cylinder has a scaled line(s) for indicating the amount of coins vertically stacked in the cylindrical columns. Coins may be inserted through a slot at the top of each cylinder. The diameter of the cylindrical columns may be slightly bigger than the diameter of the coins. The two meeting sections may be connected from a solid base portion of the article. The present invention also includes a handle and stand for supporting the coin holder. In another embodiment, a carrying case for multiple coin holders may be provided to store and carry coins in a secure manner.

19 Claims, 5 Drawing Sheets

TRANSPARENT SCALED COINS CONTAINER

FIELD OF THE INVENTION

The present invention relates to coin counters, organizers, and holders for coins, tokens, and the like. In particular, the present invention is directed toward a transparent plastic combined coin counter and holder.

BACKGROUND OF THE INVENTION

Since the very early invention of coins at the dawn of civilization (e.g., clay and early metal coins), it has been a burden for many to count, carry, save and reuse coins. Consequently many inventions have been developed over the years to overcome most of these problems related to coins. Two of the most commonly used inventions relating to coin counting, sorting, and carrying, are coin wrapping papers and coins counting machines.

Coin wrapping papers are probably the most commonly used method of grouping and storing coins today. These wrappers have remained largely unchanged for decades, with exception of pre-formed paper coin "tubes" which have recently come into use. However, this primitive method of coin storage suffers from a number of fundamental problems, regardless of whether flat papers or pre-formed tubes are used.

Coin papers require that the user first form the paper into a tube and then insert a standard amount coinage (e.g., 50 pennies, 40 nickels, or the like). There is no way for the user to determine how many coins are in the tube, other than to count the coins, weigh the tube, or somehow measure the tube height. All three of these techniques are inaccurate.

Moreover, there is no way for a bank or subsequent user to know whether there are in fact the stated number of coins in a coin roll once it has been filled. Unscrupulous persons may fill a coin roll with slugs or other worthless items, and put coins on each end. Unless the subsequent user breaks open the roll, they have no way of checking the contents of the coin roll. For a $10 roll of quarters, the potential loss for the subsequent user could be large. For this reason, many banks no longer accept rolled coins, except from account holders, and even then only if the account holder initials each roll. Retail merchants may accept such rolls only if they are broken open, necessitating counting of individual coins.

While consumers can utilize newer technology such as the retail coin counting machines found in Supermarkets and the like to dispose of their excess change, retail merchants still rely upon coin tubes to obtain a supply of change or tokens for use in their businesses. Thus, a need still exists for some form of coin storage container to handle counted amounts of coins in an easy-to handle format.

Pre-rolled paper tubes are somewhat better in that they are easier to load with coins, but they still suffer from the same problems as the flat paper coin rolls as noted above. In addition to these problems, pre-rolled coin tubes are bulky and difficult to store. In addition, both flat and pre-rolled tubes cannot be used for partial amounts of coinage, only for their stated full amounts. Moreover, paper coin wrappers cannot be re-used and thus are expensive and wasteful.

As a result of the problems with paper coin rolls, many in the Prior Art have tried to come up with improved ways for counting, storing, and handling coins.

Coins counting machines are complicated in design and production. Recalibration and maintenance of the device is necessary on a regular basis. Retail coin counting machines charge the user a fee, usually based on a percentage of coins counted (e.g., 5%) and thus can be expensive to use. A less complicated method of counting, sorting, and storing coins is needed.

There are many patents describing containers for coins counting. Hall, U.S. Pat. No. 4,339,071 issued Jul. 13, 1982, and incorporated herein by reference, discloses a Coin Bank. This coin bank provides a series of clear plastic half-tubes which may be used to stack coins and load paper coin rolls. The height of each tube is calibrated with an inner member so that a full stack of coins will provide the appropriate amount of coinage for a standard paper coin roll. There are a number of disadvantages to this design. To begin with, it is only a aid to filling paper coin rolls, not a coin holder per se. As it is calibrated only for full rolls, one cannot use the device to count coins. The size and weight of the device make it somewhat expensive and impractical for portable use. Its open design, intended for filling coin paper rolls, would allow coins to fall out if it were carried by a consumer on their person.

Hayden, U.S. Pat. No. 519,948 issued May 1, 1884, and incorporated herein by reference, discloses a coin tray. This coin tray appears to be formed by making a number of half-round grooves in a piece of wood or the like, each groove corresponding to a different denomination of coin. The apparatus is provided with indicia for indicating the amount of each denomination, and thus may be useful for counting less than roll-size amounts of coins. However, as coin counter, the apparatus is not suitable for portable storage, as it is too large, heavy, bulky, expensive, and would allow the coins to fall out once moved.

Chang, U.S. Pat. No. 4,545,394, issued Oct. 8, 1985, and incorporated herein by reference, discloses a coin counter trough. This trough is designed to be used with multiple coin sizes, but is little more than coin counter. Purifoy, U.S. Pat. No. D,303,863, issued Oct. 3, 1989, and incorporated herein by reference, discloses another variation on a slot type coin counter.

Duran, U.S. Pat. No. 3,346,109 issued Oct. 10, 1967, and incorporated herein by reference, discloses a clear view coin pack. The tube, made of plastic or glass, is provided with indicia and a snap-on or screw-off top. The Duran apparatus is too heavy and expensive to be thrown away or given away to consumers. Moreover, it requires a separate tube for each denomination of currency. In addition, the cap must be removed as additional coins are inserted.

Kelley, U.S. Pat. No. 4,036,358, issued Jul. 19, 1977, and incorporated herein by reference, discloses a clear view coin wrap. This coin wrap actually appears to be a hard plastic tube with indicia on the side for indicating the number of coins inserted. A removable funnel-top may be replaced with a snap-in lid to prevent the coins from falling out. While an interesting design and concept, the Kelley coin tube suffers from a number of disadvantages. To begin with, a fairly rigid and thick plastic casing would be needed (as shown) to hold the snap in funnel and lid. Thus the weight and cost of the apparatus would be significant. Such an apparatus would not likely be given away with a roll of coins due to its high cost. In addition, there does not appear to be any means of organizing and holding multiple numbers of such tubes together for storage.

Barnhart et al., U.S. Pat. No. 4,240,544, issued Dec. 30, 1980, and incorporated herein by reference, discloses a coin holder. A compliant plastic with a number of inner facing ribs is provided to grip and hold coins in a roll. The apparatus is provided in two halves which hinge together. Curiously, the Patent does not appear to disclose any means for maintaining the apparatus in a close position. One disadvantage of this apparatus is that it requires that the device be opened in order to insert additional coins. Each opening may wear on a plastic hinge, reducing the life of the product.

Wallace, U.S. Pat. No. 4,290,523, issued Sep. 22, 1981, and incorporated herein by reference, discloses a coin holder. Like the Barnhart Patent listed above, the Wallace Patent discloses a design with a plastic hinge and two halves which may be separated. Wallace, however, appears to make his apparatus out of a thick (e.g., injection-molded) plastic and illustrates a plastic tab mechanism for closing the device. Openings and indicia allow a lesser number of coins than a full stack to be counted. However, given the heavy plastic in this design, it does not lend itself to give-away or disposable use. Moreover, the apparatus requires opening and closing whenever additional coins are inserted, which would tend to wear out the plastic hinge and plastic tab.

Lemaire, U.S. Pat. No. 4,183,432, issued Jan. 15, 1980, and incorporated herein by reference, discloses a reusable container for coins and tokens. Lemaire also discloses a folding plastic coin container with a plastic hinge, but with multiple snap closures. No indicia are provided in the apparatus, and opening and closing of the hinge are require to insert additional coins.

Lemaire, U.S. Pat. No. 5,957,275, issued Sep. 28, 1999, and incorporated herein by reference, discloses another variation on the plastic holder. This design uses two interlocking lids for closure. Again, no indicia are provided and the apparatus must be opened and closed to add additional coins.

Rhodin, U.S. Pat. No. 3,776,375, issued Dec. 4, 1973 and incorporated herein by reference, discloses a blister package. This patent is not directed toward a coin holder, but rather generic blister packaging, which is generally designed to be sealed for one-time use.

A requirement thus remains in the art for an apparatus which is inexpensive enough to be disposable or given away by banks and the like, while still being strong enough for multiple uses. In addition, there is still a need in the art for an apparatus which can be used for various coin amounts less than a full roll size. Moreover, there is still a need in the art for a coin holder than can be easily loaded.

SUMMARY OF THE INVENTION

The present invention, which may be marketed under the name COINSMETER™ solves the problems of the Prior Art by using disposable packaging technology to form a reusable coin holder and counter. In the present invention, coins may be easily inserted in a cylinder through an opening (slot) at the top of each cylinder, no matter how the user drops the coin (heads or tails).

Free space is provided at the top of each cylinder, above a line indicating its maximum capacity of the cylinder. This free space allows the coins (including the last inserted coin) to freely fall into the tube from a slot located at the top. The free space also allows the user to identify the type and authenticity of the coins in the tube. By tilting or inclining the tube, the surface of each coin can be viewed as the coin stack inclines. In this manner, a user can verify that the coin stack does not contain slugs, foreign coins, or coins of incorrect denomination.

The scale on the body of the cylinders and its transparency feature allows checking the number of coins at any level without the need to open the article. In its simplest form, this invention is not complicated in design, light in weight and material to be used in manufacturing is cheap in cost. As a consequence, numerous articles may be produced at a time. The invention is thus suitable for large amount of coins to deal with, such as at banks, casinos, retail outlets, and other institutions where money is counted in bulk.

Unlike the Prior Art devices, which rely solely upon thick injection-molded plastics and the like, the present invention uses the low-cost and lightweight technology of the disposable packaging industry. Such packaging types of materials are typically used to packing products for sale, and such materials, although robust, are designed for a limited number of uses and may be economically discarded or given away with the product.

Unlike the coin wrapping paper rolls of the Prior Art, the present invention could be used many times without wearing out. However, the apparatus of the present invention is inexpensive enough to be given away to customers and the like, as well as disposed of after a number of uses.

The present invention may be used as a substitute of the old standard wrapping paper. The reusability, transparency and toughness feature gives the invention better competency over standard wrapping paper. It is clear that the durability of the apparatus is a factor of the material used in its production; if a durable material like plastic or glass is used it guarantees the long lasting of the article.

Moreover, the present invention is easy to use, and provides a practical solution for the problem of coins accumulation, coins dispatch, coins counting, even for large amount of coins. People dealing with large amount of coins in a daily basis, for example cashier, clerks, or the like, will find this invention very useful. Also the invention could ease the process of transporting large amount of coins from place to another without the need to recount them. The present invention provides a complete coin management system.

Socially, the present invention can help in returning the dispatched mailers of dollars to the Banking System, where it can be invested in proper manner. Furthermore, the present invention can be used as an Educational Tool in teaching children simple mathematical operations like addition, subtraction, and division. It provides the excitement of watching the coins accumulating inside the cylinder day after day.

The present invention comprises a sheet of semi-elastic plastic material which is provided with two meeting sections. In each section there is at least one grove in the shape of half cylinder. When the two meeting sections are closed the shape of full cylinder is created or a number of cylinders are created. Each cylinder has a scaled line relative to the thickness of the coins in the cylindrical columns indicating the amount of coins vertically stacked in the cylindrical columns. The diameter of the cylindrical columns may be slightly bigger than the diameter of the coins to be used. The two meeting sections are connected from a solid base portion of the article.

A slot may be provided at the top of each cylinder to allow coins to be inserted into each cylinder. In this manner, the two sections need not be disassembled in order to add more coins. Thus, coins can be added as they are received and the apparatus may be used as a bank or change storage. The use of inexpensive plastic allows the device to be given away as a promotional item, and also allows the consumer to give the apparatus to a bank or the like without incurring excessive costs. In addition, the use of inexpensive plastic allows the device to be used multiple times, but still is inexpensive enough to be thrown away after a number of uses.

The present invention also includes a handle and stand for supporting the coin holder of the present invention such that the coin holder may be used to sort and store coins as a bank or the like. In another embodiment of the present invention, a carrying case for multiple coin holders may be provided to store and carry coins in a secure manner.

DETAILED DESCRIPTION OF THE INVENTION

Figure 1:
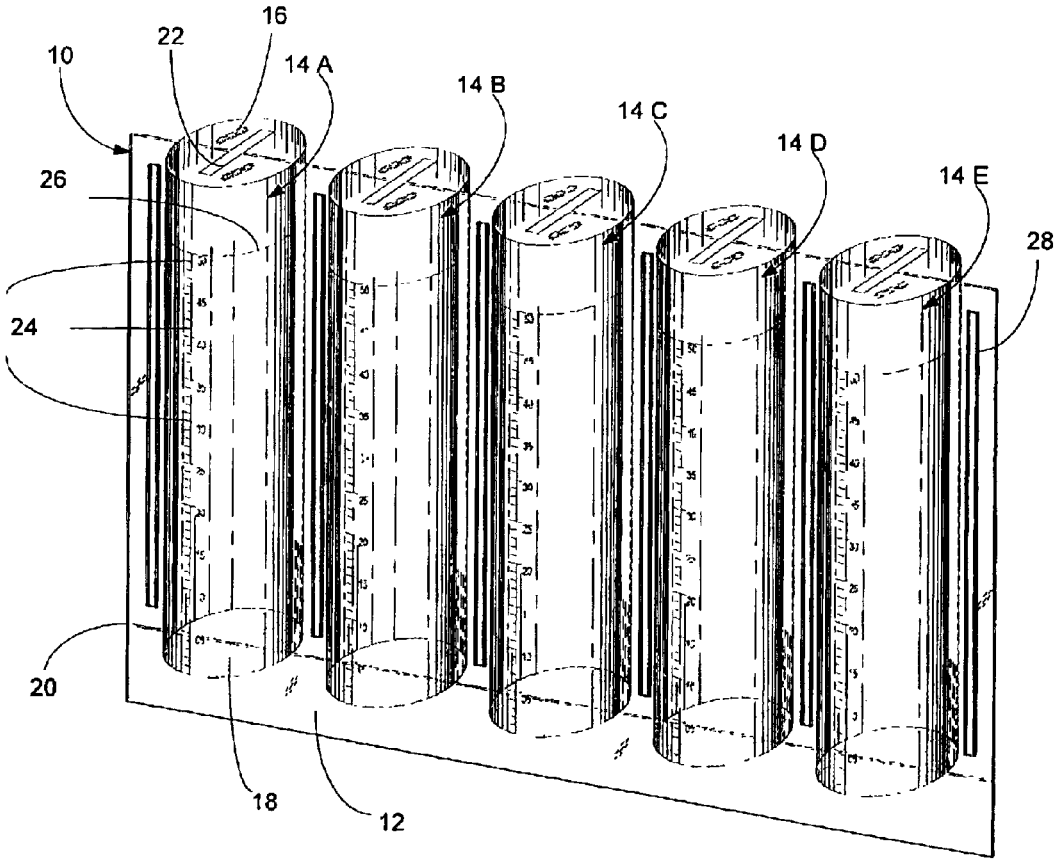
FIG. 1 is a perspective view of the coin sorter, holder, and counter of the first embodiment of the present invention.
Figure 2:
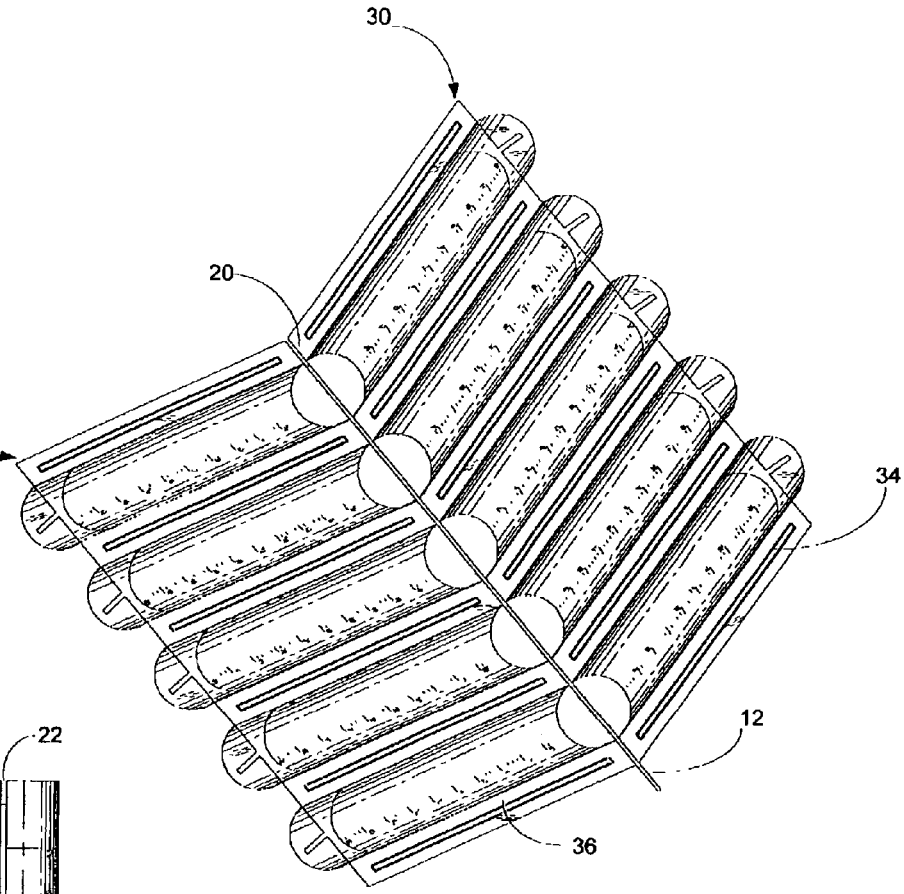
FIG. 2 is a perspective view of the first embodiment of the present invention, illustrated in an open position.
Figure 3:
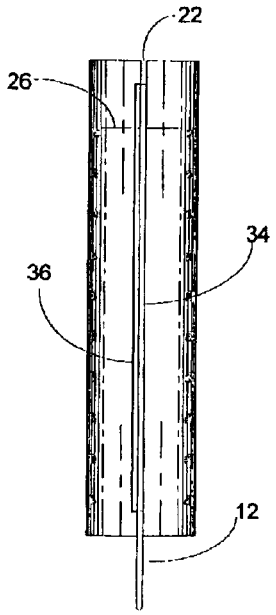
FIG. 3 is a side view of a first embodiment of the present invention.
Figure 4:
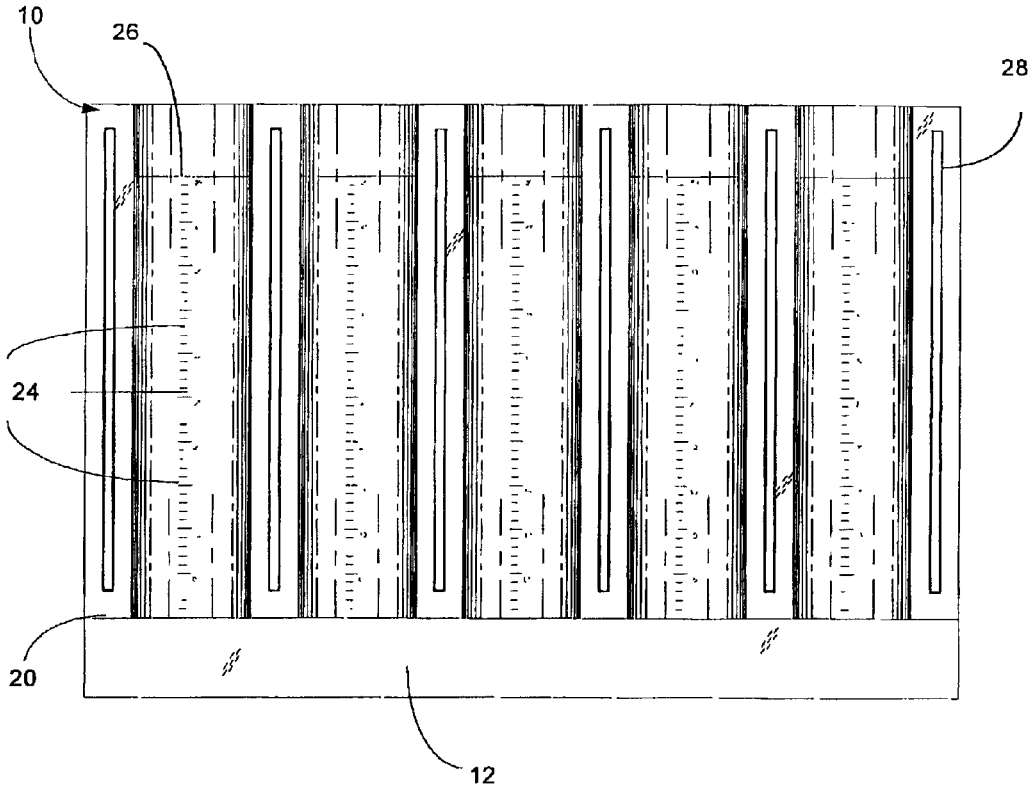
FIG. 4 is a front view of the coin sorter, holder, and counter of the first embodiment of the present invention.
Figure 5:
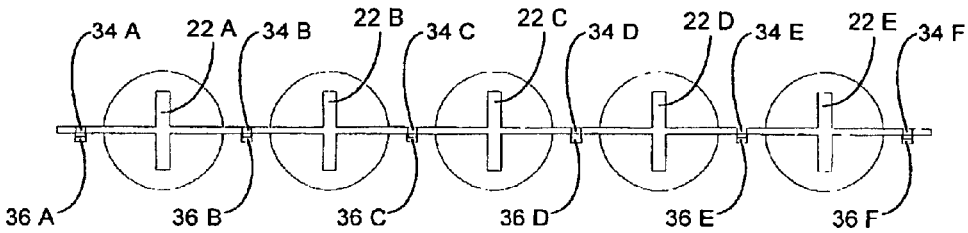
FIG. 5 is a top view of the first embodiment of the present invention.

FIG. 1 is a perspective view of the coin sorter, holder, and counter of the first embodiment of the present invention. FIG. 2 is a perspective view of the first embodiment of the present invention, illustrated in an open position. FIG. 3 is a side view of a first embodiment of the present invention. FIG. 4 is a front view of the coin sorter, holder, and counter of the first embodiment of the present invention. FIG. 5 is a top view of the first embodiment of the present invention. The coin sorter, holder, and counter may be formed from a sheet of semi-elastic plastic material 10 which is provided with two complimentary meeting sections 30 and 32 as illustrated in FIG. 2.

Sheet 10 may comprise any one (or more) of a number of kinds of plastic materials, including polyvinylchloride (PVC), Low Density Polyethylene (LDPE), Polystyrene (PS) or in the preferred embodiment, Polyethylene Terephthalate (PET). Thickness of sheet 10 may vary to some extent (e.g., 0.5 mm to 2 mm) depending upon application, the preferred embodiment being 1 mm in thickness. Recycled plastics (e.g., from soda bottles and the like, or from used articles of the present invention) may be used to reduce costs and help preserve the environment.

In each section 30, 32 there is at least one groove 36 in the shape of half cylinder. When the two meeting sections 30, 32 are brought together, the shape of full cylinder is created or a number of cylinders 14A–E are created. Note that in the example shown here, five cylinders 14A–E are illustrated. However, a greater or lesser number of cylinders 12A–E may be provided. In a simple embodiment, a single cylinder may be provided as an individual coin roll type device. In more complex embodiments, a number of cylinders may be provided as a bank or the like. In addition, perforations (not shown) between cylinders may be provided to allow a user to separate individual cylinders 14A–E to create smaller groups of cylinders or individual coin rolls.

Each cylinder 14A–E may have indicia 26 relative to the thickness of the coins in the cylindrical columns indicating the amount of coins vertically stacked in cylinders 14A–E. A maximum capacity mark 26 may indicate when a standard number of coins (e.g., coin roll amount) has been inserted.

The diameter of the cylindrical columns 14A–E may be slightly bigger than the diameter of the coins or tokens to be used in order to allow the coins to freely drop into the cylinder. All of cylinders 14A–E may be of identical size to contain the same coin or token type, or may be of a variety of sizes to contain other sizes of coins (e.g, quarters, nickels, dimes, pennies).

The two meeting sections 30, 32 are connected from a solid base portion 12 which may be provided with a hinge or fold line 20. Fold line 20 may be molded into the article so as to allow the two halves 30, 32 to pivot. Alternately, base portion 12 may be eliminated and the two halves 30, 32 hinged and connected directly to each other along fold line 20.

A slot 22 may be provided at the top portion 16 of each cylinder 14A–E to allow coins to be inserted into each cylinder 14A–E. In the preferred embodiment, the axis of coin insertion on the top of the cylinder is preferably perpendicular to the axis of the base joining line. This arrangement prevents the coins from becoming trapped in the gap between the two sheets of material. Moreover, the slot allows the coins to be inserted to the cylinder and prevents the coins from falling out of the cylinder accidentally.

FIG. 5 illustrates these corresponding slots 22A–E for each of cylinders 14A–E. In this manner, the two sections 30, 32 need not be disassembled in order to add more coins. In use, coins may be inserted into a slot 22, where they fall to the base 18 of the corresponding cylinder 14A–E. As the diameter of each cylinder 14A–E is slightly larger than the coin, the coins may freely fall to the base 18 of the corresponding cylinder 14A–E.

Thus, coins can be added as they are received and the apparatus may be used as a bank or change storage. The use of inexpensive plastic allows the device to be given away as a promotional item, and also allows the consumer to give the apparatus back to a bank or the like (e.g., for counting and deposit) without incurring excessive costs. In addition, the use of inexpensive plastic allows the device to be used multiple times, but still is inexpensive enough to be thrown away after a number of uses.

Fit-in flanges 28 formed in flange portion 34 may be used to assemble the two halves 30, 32 together. These flanges may take the form of complimentary snap-together pieces 34, 36, as is known in the packaging art. FIG. 5 illustrates these complimentary snap-together flanges and grooves as elements 34A–F and 36A–F. Although in the preferred embodiment such flanges may be provided in either side of each cylinder 14A–E, a lesser or greater number of flanges may be used. For example, if perforations (not shown) are supplied to allow individual cylinders to be separated from one another, additional flanges may be provided to retain the integrity of each cylinder.

The use of such flanges allows the apparatus to be opened and emptied of its coins at a later time. Alternately, other types of snaps or connectors may be used, including but not limited to, snap button portions, metal snaps, fasteners, hook-and-loop fasteners (e.g., VELCRO® or the like) and other types of fastening systems. In addition, the two halves 30, 32 may be heat welded, glued, or otherwise permanently or semi-permanently held together. In a heat welded embodiment, the apparatus may be intended for single use, or may have slots 22 expanded to allow coins to be removed through such expanded slots 22 or openings.

Figure 6:
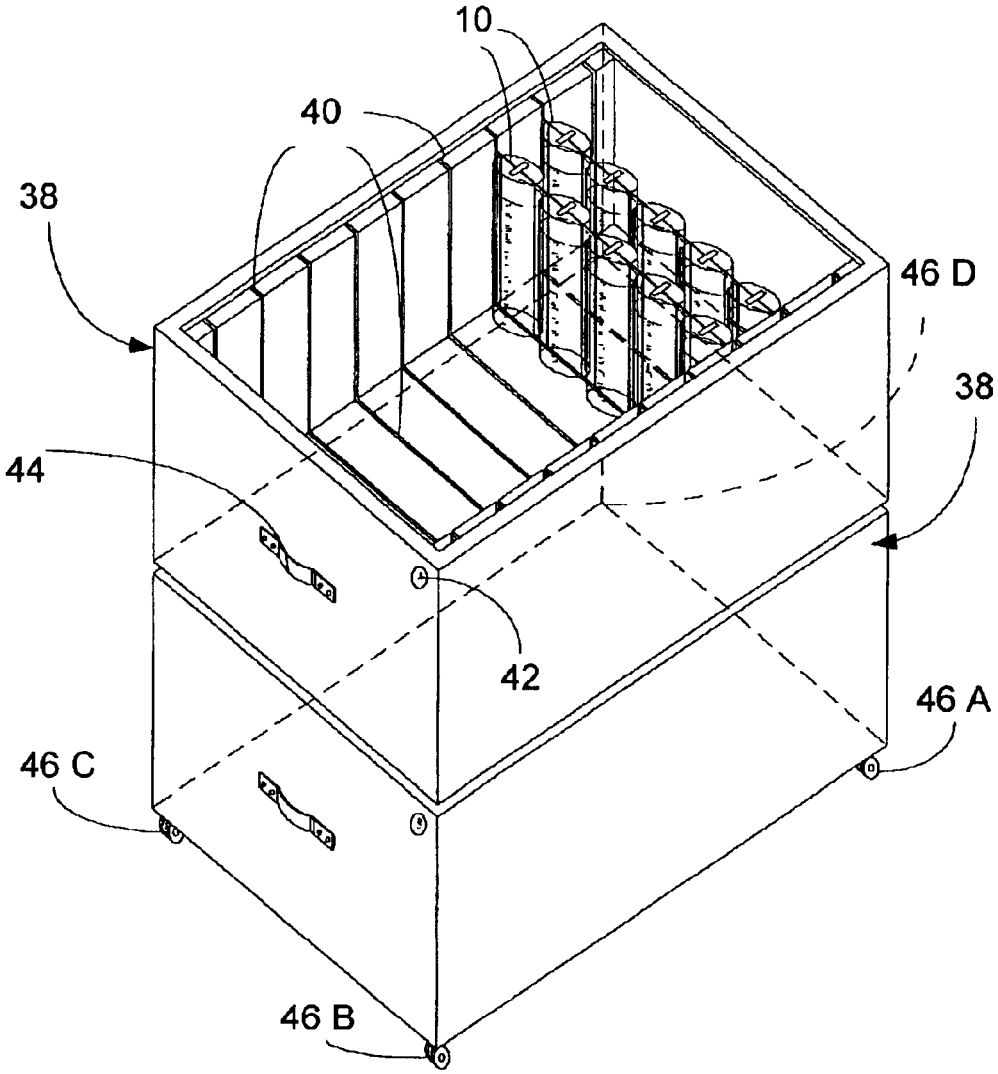
FIG. 6 is a perspective view of a carrier device for the coin sorter, holder, and counter of the present invention.

FIG. 6 is a perspective view of a carrier device 38 for the coin sorter, holder, and counter of the present invention. In this embodiment of the present invention, a carrying case 38 for multiple coin holders 10 may be provided to store and carry coins in a secure manner. Case 38 may be provided with a number of grooves 40 for accepting the edges of the enclosure sheets of coin holders 10. In this manner, coin holders 10 are held in a secure upright position such that coins cannot fall out through slots 22.

A corresponding lid (not shown) may be secured to carrying case 38 via locking system 42. Locking system 42 may also be used to lock multiple carrying cases 38 together to form a stack of such cases. A handle 44 may be provided to move or carry such cases 38. Wheels 46A–D may be provided or removably provided on cases 38 to allow such cases to be wheeled on the floor or a desk. In this manner, a number of coins or tokens may be securely stored, counted, and stacked. Carrying cases 38 may be used as a bank or cash register type device for small businesses and retailers where coins or tokens are received from consumers.

Figure 7:
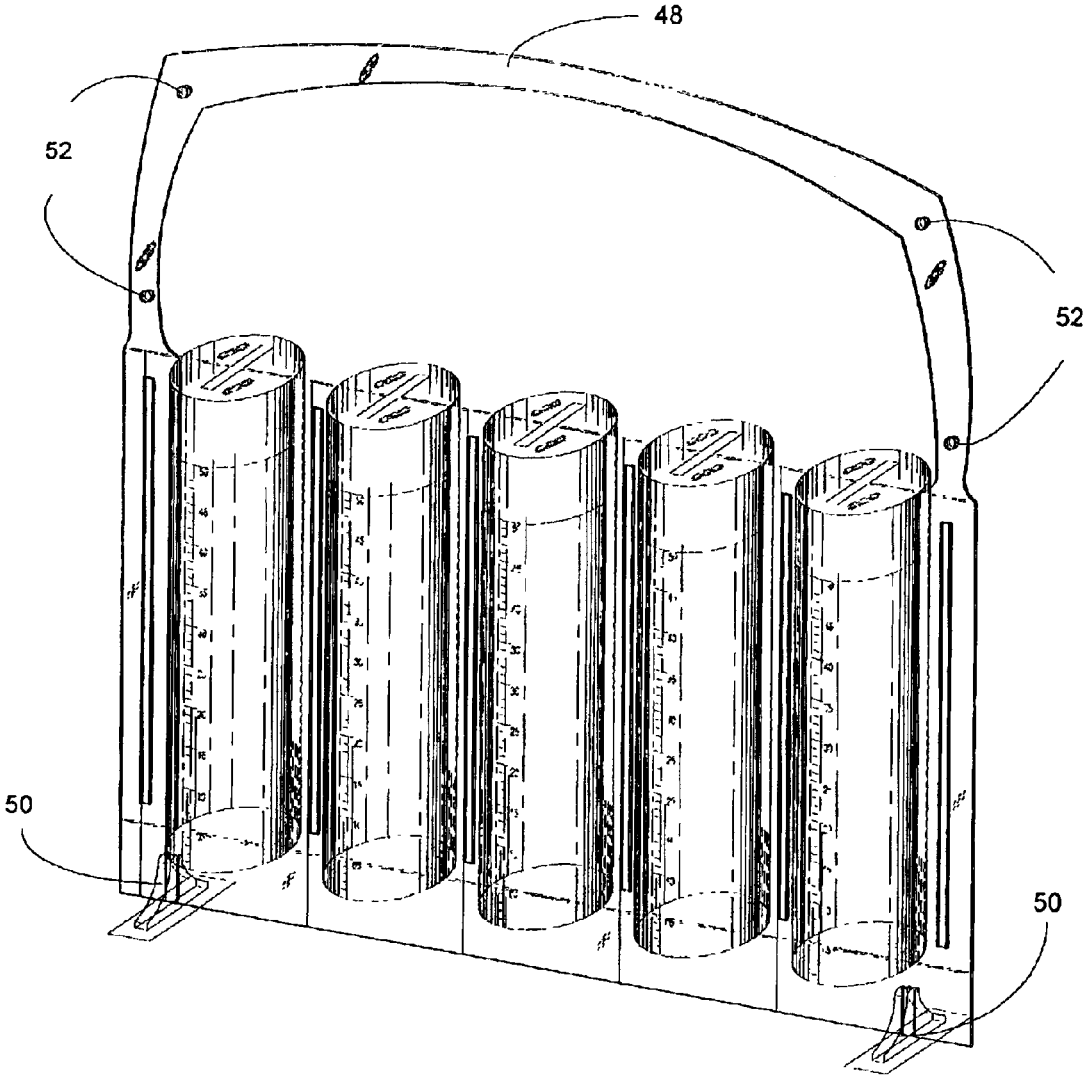
FIG. 7 is a perspective view of a carrier device for the coin sorter, holder, and counter of the present invention illustrating a handle and support stand.

In another embodiment of the present invention, a handle and stand may be provided for supporting the coin holder of the present invention such that the coin holder may be used to sort and store coins as a bank or the like. FIG. 7 is a perspective view of such an embodiment of the coin carrier device for the coin sorter, holder, and counter of the present invention illustrating a handle and support stand. As in the embodiments of FIGS. 1–5, the holder is comprised of two parts, each one an extension of the two meeting sections. The two parts of the coin holder may be assembled to another using a button and cavity snaps 52 (as known in the packaging art) in addition to, or as a substitute for, the flange and grooves 34, 36 of FIGS. 1–5.

Handle 48 may be provided as part of the holder 10 and may be used to carry holder 10 in a secure manner. Handle 48 may be folded out of the way for storage in case 38 or may be removed via perforations (not shown) or may be cut off with scissors if desired. Support stands 50 may be provided as a pair of molded plastic stands which may interface with the flange portion of coin sorter 10. By inserting the apparatus 10 into stands 50, the device 10 may form a stand alone bank or coin sorter. Stands 50 may be removed and used with another device 10 when a device is filled with coins.

The present invention may be inexpensively manufactured using a number of known techniques. Flat plastic sheet material may be placed on a vacuum-forming mold, for example. The material may be heated until it is pliable, and a vacuum formed underneath, pulling the material into a desired shape such as that illustrated in the Figures here. Seams or joints may be formed by plastic heat welding, adhesives, or the like. Indicia may be printed (e.g., silkscreen, lithography or the like) and may be applied prior to molding or after. Indicia may also be formed in the molding process as raised marks and letters or numerals. Of course, other plastic fabrication processes may be used as is known in the art. In one embodiment, blister packaging equipment or the like may be used to manufacture the present invention. Other manufacturing techniques, such as injection-molding or the like, may also be used with the present invention.

While the preferred embodiment and various alternative embodiments of the invention have been disclosed and described in detail herein, it may be apparent to those skilled in the art that various changes in form and detail may be made therein without departing from the spirit and scope thereof.

For example, while the device is disclosed as being made from a sheet of material folded into two halves, it may also be made from two sheets glued, heat welded, or otherwise joined so as form the present invention. Moreover, although the slots of the present invention are illustrated on the top of the cylinder, they may be formed on the side of the top portion to allow coins to be inserted from the side. In such an alternative embodiment, the amount of space at the top of the cylinder may be reduced somewhat.

Similarly, while the preferred embodiment is provided with coin slot and space at the top to allow coins to drop, in an alternative embodiment of the present invention, the apparatus may be provided without such a coin slot so as to be used, for example, for shipping full rolls of coins from a bank, mint, or other coin depository. Alternately, a coin slot may be plugged with a removable and reusable plug, or the coin slot may be perforated so as to be removable from the apparatus.

I claim:

1. A coin storage device, comprising:

a substantially planar sheet material having a first half and a second half, where of the first half and the second half each have at least one substantially half-cylinder recessed portion formed on the surface of the substantially planar sheet material such that when the first half and second half of the substantially planar sheet material are folded and mated, the at least one substantially half-cylinder recessed portion mate form at least one cylinder and the first half and the second half of the substantially planar sheet material lie flat against one another; and at least one slot, corresponding to each said at least one cylinder each slot formed in a top portion of one said at least one cylinder for accepting coins; and means for joining the mated first and second halves together so as to maintain the formation of said at least one cylinder.

2. The coin storage device of claim 1, wherein the means for joining comprises a plurality of grooves and mating flanges formed opposite to one another on corresponding portions of the first half and second half of the substantially planar sheet material, such that each of the plurality of grooves mates with a corresponding flange when the first half and second half are mated to form the at least one cylinder.

3. The coin storage device of claim 1, wherein the means for joining comprises a plurality of buttons and cavities formed opposite to one another on corresponding portions of the first half and second half of the substantially planar sheet material, such that each of the plurality of buttons mates with a corresponding cavity when the first half and second half are mated to form the at least one cylinder.

4. The coin storage device of claim 1, further comprising:

indicia, on the side of said at least one cylinder, for indicating a number of coins in the at least one cylinder.

5. The coin storage device of claim 4, wherein the indicia comprises a fill line indicating when a predetermined number of coins has been inserted into the at least one cylinder.

6. The coin storage device of claim 4, wherein the indicia comprises a plurality of lines and corresponding numbers for measuring the number of coins inserted into the at least one cylinder.

7. The coin storage device of claim 1, wherein said at least one cylinder is provided with a sufficient height to hold a predetermined number of coins and also provide a sufficient additional space to allow coins to be inserted through the at least one slot so as to allow the coins to fall flat parallel to the bottom of the at least one cylinder and also to allow the coins to be lain at an angle in the at least one cylinder so that the coins may be visually inspected.

8. The coin storage device of claim 1, wherein the at least one cylinder comprises a plurality of cylinders, each cylinder having a diameter corresponding to a predetermined denomination of coin.

9. The coin storage device of claim 1, wherein the at least one cylinder has a diameter slightly larger than a predetermined denomination of coin so as to allow such denomination of coin to slide down the at least one cylinder.

10. The coin storage device of claim 1, further comprising:

a handle, formed at a top portion of the coin storage device, for carrying the coin storage device.

11. The coin storage device of claim 10, further comprising:

at least one support stand, gripping an edge portion of the substantially planar sheet material, for supporting the coin storage device in an upright position.

12. The coin storage device of claim 11, wherein the substantially planar sheet material comprises a substantially transparent material.

13. The coin storage device of claim 1, wherein the substantially planar sheet material comprises any one of polyvinylchloride (PVC), low density polyethylene (LDPE), polystyrene (PS) or polyethylene terephthalate (PET).

14. The coin storage device of claim 13, wherein the substantially planar sheet material comprises a substantially translucent material.

15. The coin storage device of claim 1, where in the substantially planar sheet material has a thickness from 0.5 mm to 2 mm.

16. A coin storage device comprising:

a substantially planar sheet material having a first half and a second half, where the first half and the second half each have at least one substantially half-cylinder recessed portion formed on the surface of the substantially planar sheet material such that when the first half and second half are folded and mated, the at least one substantially half-cylinder recessed portions mate to form at least one cylinder;

at least one slot, corresponding to each said at least one cylinder each slot and formed in a top portion of one said at least one cylinder for accepting coins; and means for joining the mated first and second halves together so as to maintain the formation of said at least one cylinder wherein the at least one cylinder has a diameter slightly larger than a predetermined denomination of coin so as to allow such denomination of coin to slide down the at least one cylinder, and wherein said at least one slot is formed on the top surface of a corresponding said at least one cylinder such that the at least one slot is oriented substantially perpendicular from the plane of the substantially planar sheet material such that coins inserted into the at least one slot are not caught by a seam between the first half and the second half of the substantially planar material.

17. An apparatus for storing coins comprising:

a container for accepting at least coin storage device, the container comprising a cavity for accepting the at least one of the coin storage device in an upright position; and at least one coin storage device, each at least one said coin storage device comprising:

a substantially planar sheet material having a first half and a second half, where each of the first half and the second half each have at least one substantially half-cylinder recessed portion formed on the surface of the substantially planar sheet material such that when the first half and second half of the substantially planar sheet material are folded and mated, the at least one substantially half-cylinder recessed portions mate to form at least one cylinder and the first half and the second half of the substantially planar sheet material lie flat against one another; and, at least one slot, corresponding to each said at least one cylinder each slot formed in a top portion of one said at least one cylinder for accepting coins, and means for joining the first and second half of the planar sheet material together so as to maintain the formation of the at least one cylinder.

18. The apparatus of claim 17, wherein the container further comprises:

plurality of vertical grooves formed in a side portion of the cavity, for accepting edges of the substantially planar sheet material so as to hold said at least one coin storage device in an upright position.

19. The apparatus of claim 18, wherein the container further comprises:

a cover, securably lockable over the cavity.

* * * * *